United States Patent [19]

Titus

[11] Patent Number: 4,788,988

[45] Date of Patent: Dec. 6, 1988

[54] SMOKING DEVICE

[76] Inventor: Matthew G. Titus, 4604 Woodduck La., Salt Lake City, Utah 84117

[21] Appl. No.: 9,230

[22] Filed: Jan. 30, 1987

[51] Int. Cl.[4] ..... A24F 1/28; A24F 1/30

[52] U.S. Cl. ..... 131/198.2; 131/173; 131/180; 131/190; 131/191; 131/204; 131/215.1; 131/215.2; 131/215.3; 131/227; 131/226; 131/223

[58] Field of Search ..... 131/198.2, 173, 180, 131/190, 191, 204, 215.1, 215.2, 215.3, 227, 223, 226

[56] References Cited

U.S. PATENT DOCUMENTS

| | | | |
|---|---|---|---|
| 2,612,173 | 9/1952 | Gustafson | 131/223 |
| 3,294,098 | 12/1966 | Gustafson | 131/223 |
| 4,253,475 | 3/1981 | Schreiber et al. | 131/198.2 |

FOREIGN PATENT DOCUMENTS

| | | | |
|---|---|---|---|
| 0829235 | 1/1952 | Fed. Rep. of Germany | 131/227 |

*Primary Examiner*—V. Millin

*Attorney, Agent, or Firm*—Richard F. Bojanowski

[57] ABSTRACT

A smoking device is disclosed whereby smoke and other gases of combustion can be diluted with air to a pre-selected mixture before being inhaled by a smoker. This is achieved by the use of a carbureting tube which can introduce a metered amount of air into a smoke chamber and thereby dilute the smoke to any desired concentration. The smoke is drawn into the smoke dilution chamber by a piston moving towards the outlet end of the chamber, and then pumped out of the smoke dilution chamber by reversing the motion of the piston. A water chamber may also be included to permit the smoke and other gases to be cooled prior to entering the smoke dilution chamber.

13 Claims, 5 Drawing Sheets

SMOKING DEVICE

BACKGROUND OF THE INVENTION

This invention relates generally to a smoking device and particularly to a device which permits smoke entering a smoke chamber to be diluted to a concentration desired by a user.

The prior art relating to smoking devices can be readily found in a number of United States and foreign patents. Some of the more pertinent patents include U.S. Pat. Nos. 402,681; 3,881,499; 3,889,690; 3,804,100; 3,918,464; and 4,193,411. The most basic of all these devices is disclosed in U.S. Pat. No. 402,681. This patent discloses a reciprocatable piston contained within a cylinder with the inlet and outlet ends fitted with check valves to permit a flow of gases in one direction. The remaining patents disclose various unique ways in which burning or ignition of a substance can be achieved. Others show various systems for assisting the user in moving smoke from a combustion chamber to an outlet. U.S. Pat. No. 3,804,100 discloses the use of a valved air vent to control the amount of pressurized air that will enter the combustion chamber.

None of the above patents discloses or suggests a simple system for delivering a broad range of smoke concentrations to an outlet. In other words, no device could be found which was capable of diluting smoke to a desired concentration. Essentially all of the prior art that could be found disclose various devices for delivering maximum concentrations of smoke to a user. However, there are many users today who are interested in reducing or eliminating the habits of smoke and attempt to achieve this goal by gradually reducing their inhalation of smoke over a period of time. This result can be readily achieved by a device which dilutes smoke with air to a concentration which is best suited to the needs of a user. This invention may also be used to introduce prescribed controlled volumes of a gaseous material to trauma patients under a doctor's care.

SUMMARY AND OBJECTS OF THIS INVENTION

It is therefore a primary object of this invention to provide a device which permits a user to select the concentration of smoke to be delivered.

Another object of this invention is to provide an inexpensive system for delivering various concentrations of smoke to the user.

Still another object is to provide a system which minimizes some of the harshness and hazards of smoking.

Other objects shall be apparent from the descriptions and claims to follow, taken in conjunction with the drawings.

The above and other objects of this invention can be readily achieved by a smoking device employing a piston and cylinder adapted with a carbureting tube for controlling the amount of air which is to be mixed with the smoke prior to discharge.

Basically, the device of this invention includes a cylindrical housing having an inlet end and an outlet end. Inside the cylindrical housing is a cylinder or plunger capable of creating a suction when moved in one direction. During this suction stroke, smoke is drawn from a combustion bowl into a smoke dilution chamber created by movement of the plunger away from the combustion bowl or inlet end of the cylindrical housing. Concomitant therewith, air is introduced into the smoke dilution chamber through a hollow carbureting tube which extends the entire length of the housing. The end of the carbureting tube within the housing is circumscribed by the plunger while the other end of the tube extends beyond the confines of the housing. This tube also serves as the means by which the reciprocating movement can be generated and transferred to the plunger. As the smoke is drawn into the smoke dilution chamber, the amount of air that combines with the smoke is controlled by the user's thumb or finger being placed over the end of the carbureting tube. If the end is partially blocked, i.e. throttled, some air shall be drawn through the tube and into the smoke dilution chamber. After the desired concentration of smoke and air has been obtained, the thumb or finger is removed and the end of the carbureting tube is introduced into the users mouth. The channel between the combustion chamber and the smoke dilution chamber is then closed through a valving system and the plunger is moved downward. The smoke and air mixture is then forced through the carbureting tube to the user. The amount of smoke and air mixture to be delivered is controlled by the depth of the expulsion stroke. By moving the plunger half way, only one half of the contents of the smoke dilution chamber shall be delivered to the user.

In some more preferred embodiments, a water chamber may be inserted between the combustion chamber and the smoke dilution chamber to cool and purify the smoke collected therein. In other systems, various types of valving systems may be incorporated to close off communication between the combustion chamber and the smoke dilution chamber as the plunger completes it's suction stroke and converts over to it's evacuation stroke.

DETAILED DESCRIPTION OF THE PREFERRED EMBODIMENT

Figure 1:
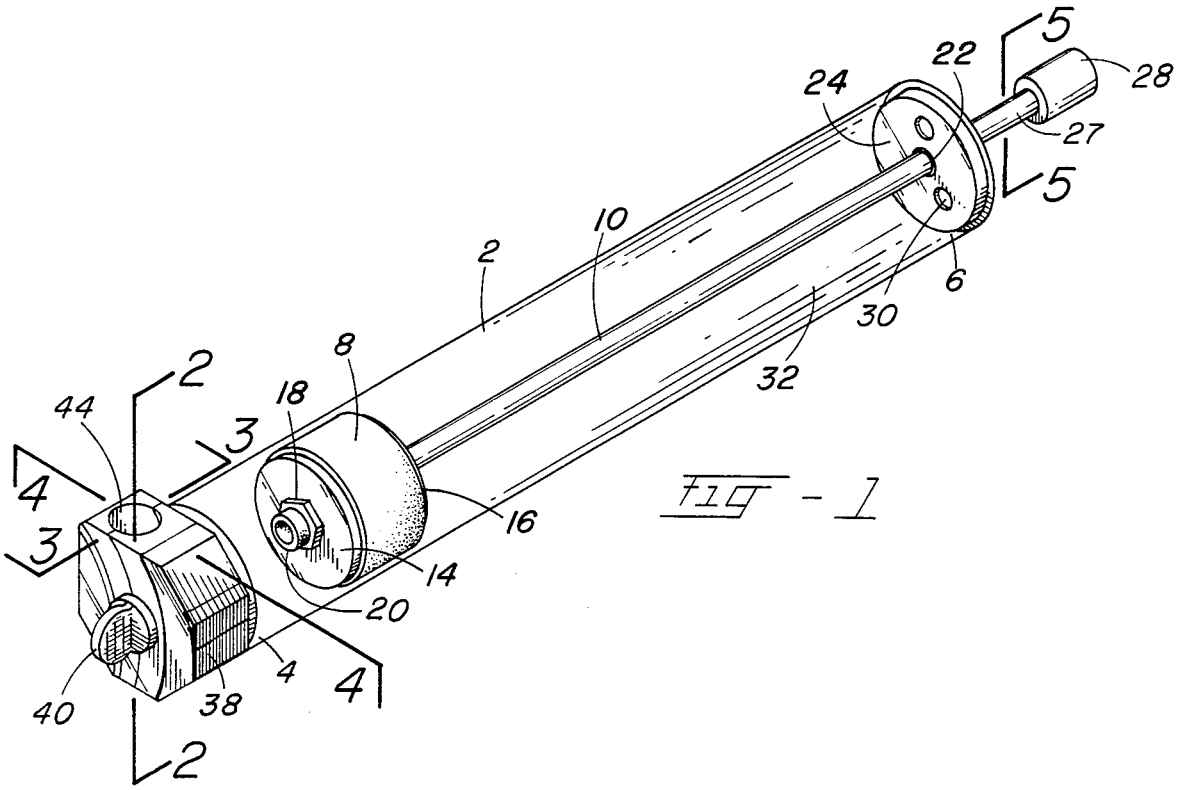
FIG. 1 is an isometrical view of the smoking device of this invention.
Figure 2:
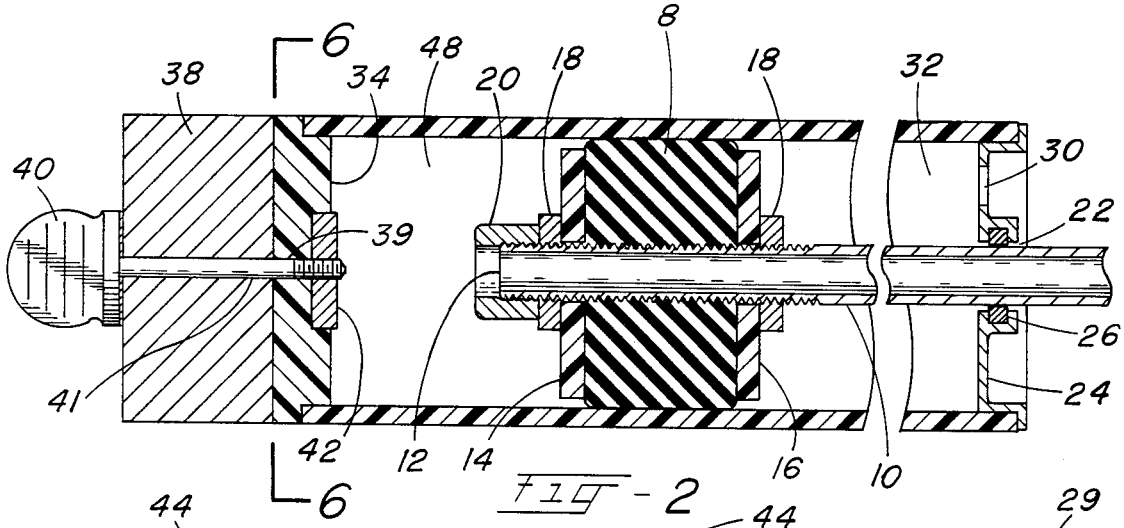
FIG. 2 is a sectional view taken along line 2—2 as shown in FIG. 1.

Referring particularly to FIGS. 1 through 7, there is depicted a smoking device having a cylindrical housing 2 including an inlet end 4 and an outlet end 6. Within the housing 2 is a cylinder or plunger 8. The cylinder or plunger is constructed from an expandable rubber or plastic material having an outer diameter slightly larger than the inner diameter of the cylindrical housing 2. Extending through the plunger 8 and outwardly beyond the outlet end of the housing, is an elongated reciprocatable hollow carbureting tube 10 threaded at the plunger end 12. On both of the flat faces of the plunger, washers or disks 14 and 16 respectively are securely positioned thereto by threaded nuts 18. At the end of the threaded carbureting tube is a rubber stop member 20 to cushion the contact of the plunger when it reaches the cylindrical housing's limit. The other end of the reciprocatable hollow carbureting tube 10 passes through a central opening 22 bored in a cover or cap 24 which closes the outlet end 6 of the cylindrical housing 2. The cover or cap and the carbureting tube 10 are separated by a Nylon or Teflon "O" ring 26 to provide a sealed environment therebetween and to provide a smooth lubricating surface for the carbureting tube 10 as it is slid in and out. The outlet end of the carbureting tube is threaded and fitted with a matching threaded removable mouth piece 28. Preferrably the mouth piece 28 is fitted along it's inner wall with a filter-like substance 29 (FIG. 5), to capture impurities or other unwanted materials. The cap or cover 24 contains one or more vent holes 30 to permit air to escape from the housing's air chamber 32 during the suction stroke of plunger 8. The suction stroke is defined as the movement of the plunger 8 when the plunger is pulled toward the outlet end 6 of the cylindrical housing 2.

Figure 3:
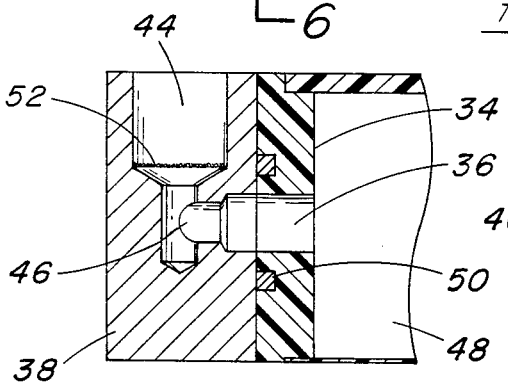
FIG. 3 is a sectional view taken along line 3—3 as shown in FIG. 1.
Figure 4:
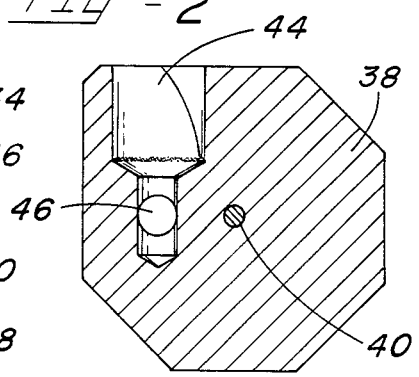
FIG. 4 is a sectional view taken along line 4—4 as shown in FIG. 1.
Figure 5:
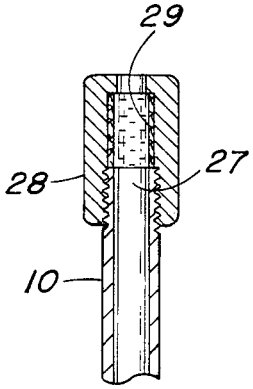
FIG. 5 is a sectional view taken along line 5—5 as shown in FIG. 1.

The inlet end 4 of the cylindrical housing 2 is fitted with a second cap or cover 34 having an off center bored opening 36 (FIG. 3). A combustion base member 38 is held to the cap 34 by a finger bolt 40 extending through a central opening 41 bored through the base member 38 and in communication with centrally bored opening 39 in cap 34. The base member 38 and cap 34 are secured thereto by nut 42.

The combustion base member contains a bored bowl 44 holding a screen base 52 in which the materials to be burned are placed. The bottom of the bowl is in communication with a right-angled channel or conduit 46 opening against the outside face of cap 34. Upon loosening of the finger bolt 40, the combustion base may be rotated to permit the right-angled conduit 46 to match and communicate with the opening 36 of cap 34 as shown in FIG. 3. This permits the smoke generated by the burning of a substance in bowl 44 to pass through the right-angled conduit 46 and opening 36 into the smoke dilution chamber 48 formed when the plunger is moved towards the outlet 6 of housing 2. As the plunger moves towards the outlet, with the outlet of the carbureting tube being closed, a suction is created. This is referred to as the plunger's suction thrust. The smoke is then drawn from the bowl and into the smoke dilution chamber. The amount of suction can be reduced by permitting some air to enter through the carbureting tube 10 by reducing the finger pressure exerted on the mouthpiece 28 carried on the outlet opening 27. The finger thereby functions as a bleeder valve. When the plunger has been extended the desired distance, the finger bolt 40 is loosened and the combustion base member is rotated, disrupting the communication between the right-angled channel and opening 36 causing the flow of smoke to cease. The finger bolt 40 is then tightened and the expulsion stroke may be initiated by removing the finger from the mouthpiece and pushing the plunger 8 toward the inlet end 4.

To permit the plunger 8 to move freely within the cylindrical housing 6, vent holes 30, as previously noted, are available to permit the ingress and egress of air from the air chamber 32. As the plunger is moved toward the inlet end 4 of the housing, air is taken into the air chamber. As the plungers direction is reversed, air is expelled from the air chamber.

Figures 6, 7:
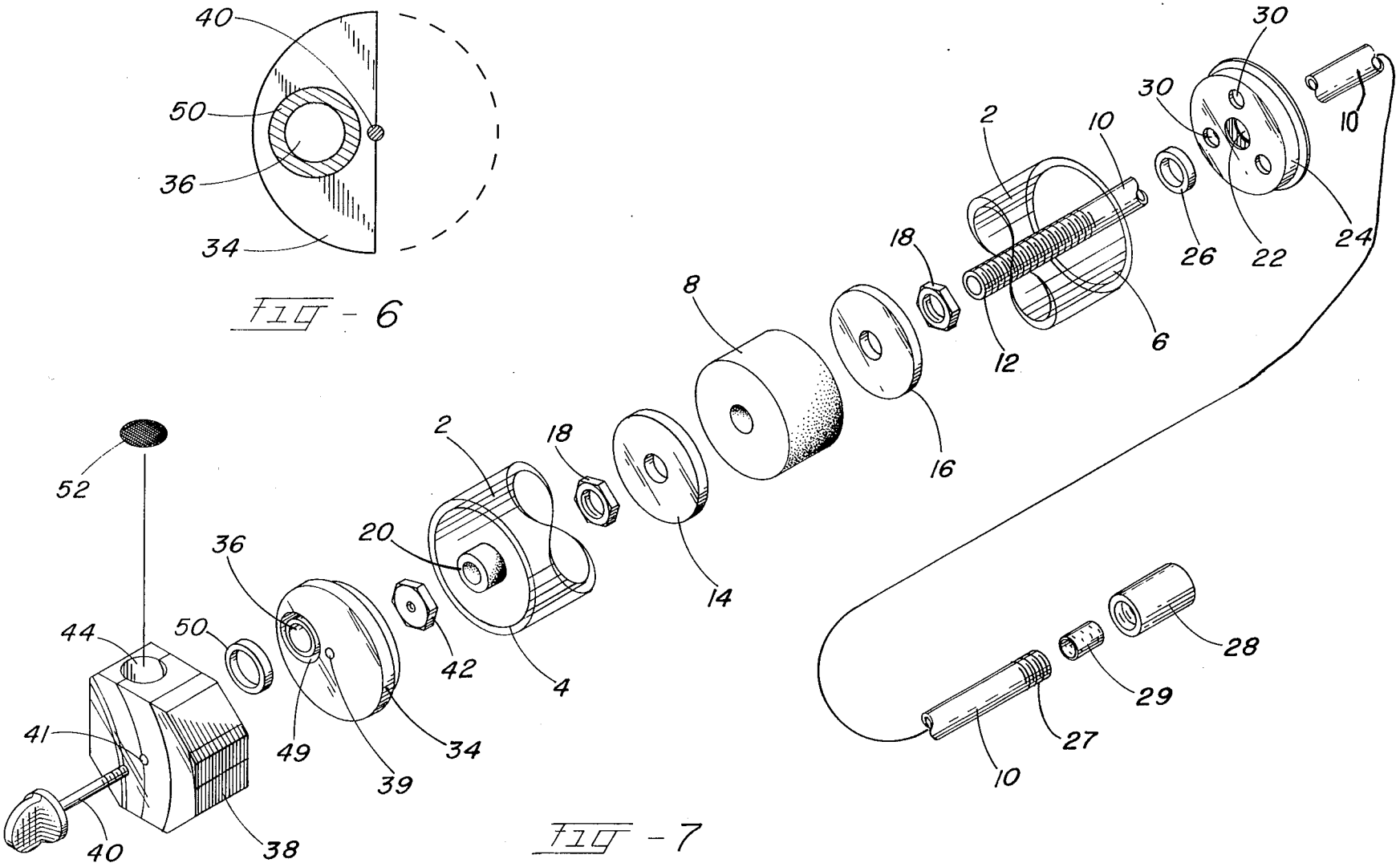
FIG. 6 is a sectional view taken along line 6—6 as shown in FIG. 2.
FIG. 7 is an exploded view of the smoking device of claim 1.

Referring to FIGS. 6 and 7, it can be seen that the second cap 34 contains a circular groove 49 for receiving a heat gasket 50. This insures sealing and prevents smoke from seeping out to the atmosphere during the expulsion or exhaustion stroke and prevents undesirable air from seeping into the smoke dilution chamber during the vacuum stroke.

In another embodiment of this invention, the basic elements heretofore described are incorporated herein. In addition, a water chamber is included along with a more sophisticated type of valve system.

Figure 8:
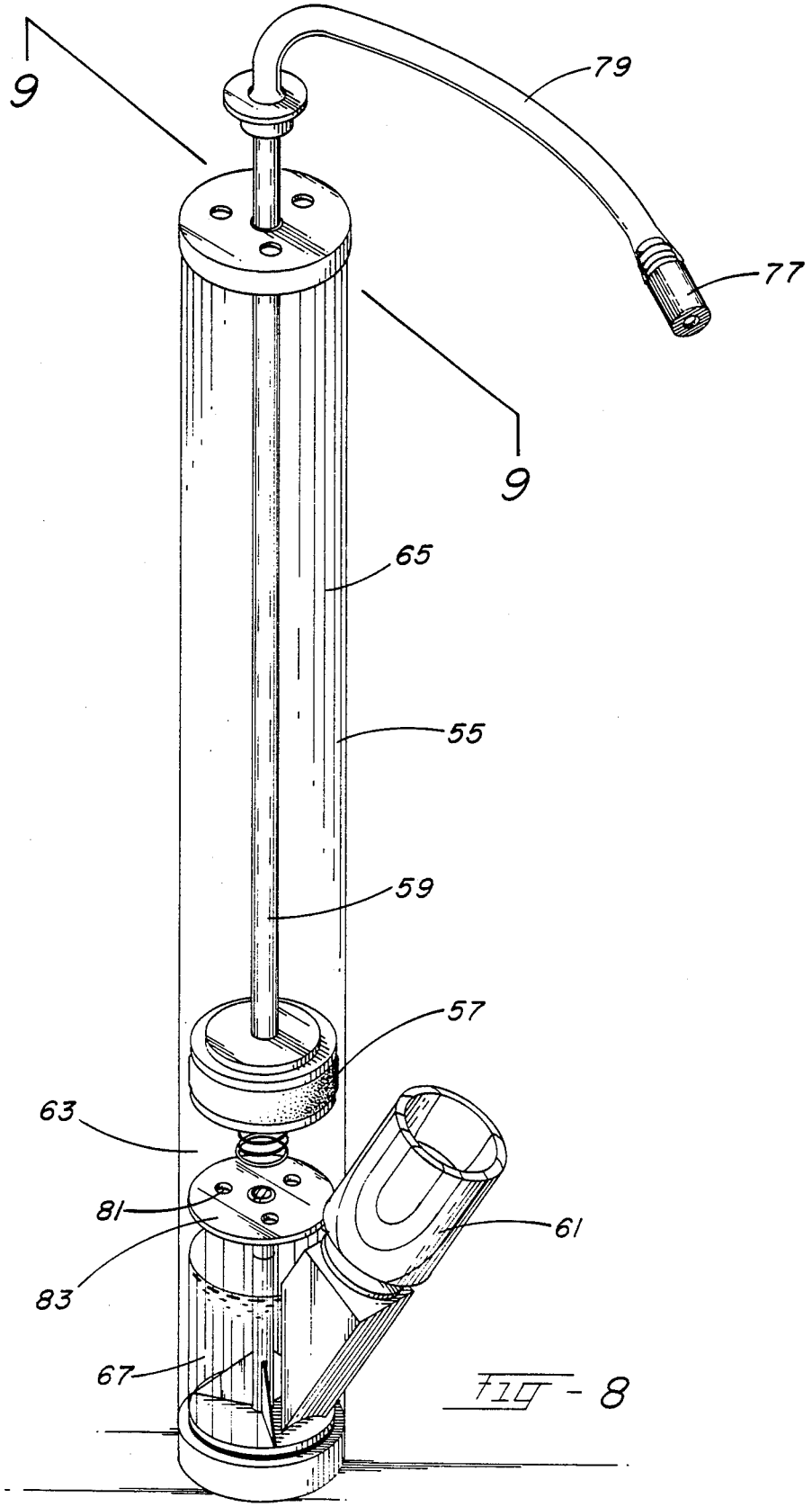
FIG. 8 is a isometrical view of a smoking device incorporating another embodiment of this invention.
Figure 9:
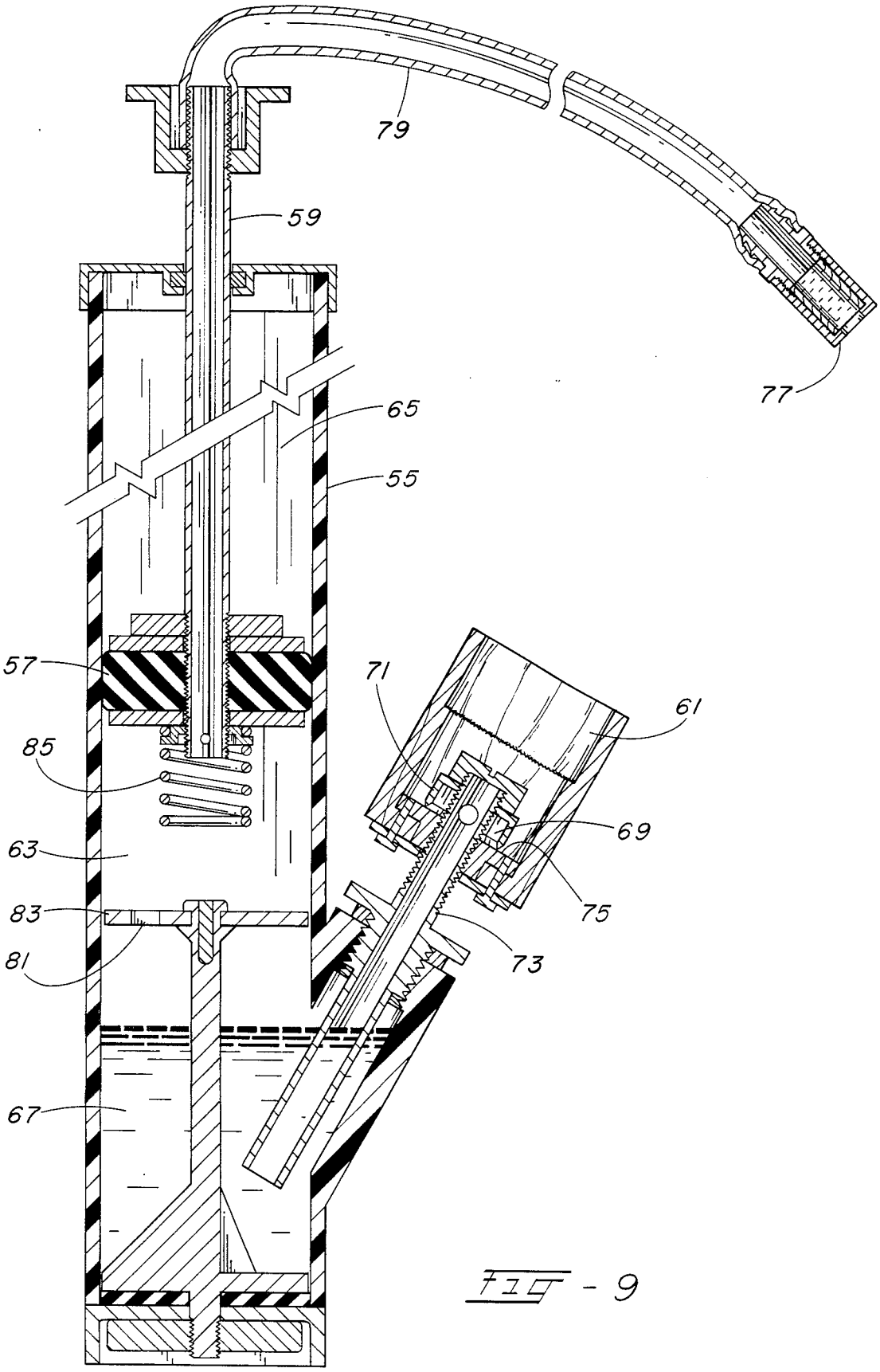
FIG. 9 is a cross-sectional view taken along line 9—9 as shown in FIG. 8.

Referring now to FIGS. 8 and 9, it can be seen that this embodiment incorporates a cylindrical housing 55, a plunger 57 connected to a carbureting tube 59 and a combustion chamber 61. The plunger 57 separates the housing into a smoke dilution chamber 63 and an air chamber 65.

A feature that was not included in the first embodiment, but which is included in this embodiment, is a water chamber 67. The valving system 69 used in this embodiment is more intricate. In this embodiment, a valve cup 71 is secured to an elongated conduit 73 which, when in a closed position, is in sealing communication with a valve slot 75. By turning the bowl counterclockwise, the valve cup 71 is separated from the valve slot 75 permitting communication between the combustion chamber 61 and the water chamber 67 through the elongated conduit 73. The smoke having passed into the water chamber is pulled into the smoke dilution chamber 63 as the carbureting tube 59 is pulled upwardly with a finger on the mouthpiece 77 connected to the carbureting tube by an intermediate hose 79. The water-cooled smoke passes into the smoke dilution chamber through openings 81 contained in a splash plate 83 which separates the water chamber 67 from the smoke dilution chamber 63. A spring 85 is also provided as a stop member to cushion contact between the end of the carbureting tube and the splash plate 83. The remaining elements used in this embodiment are essentially the same as the first embodiment, and therefore shall not be further described.

Figure 10:
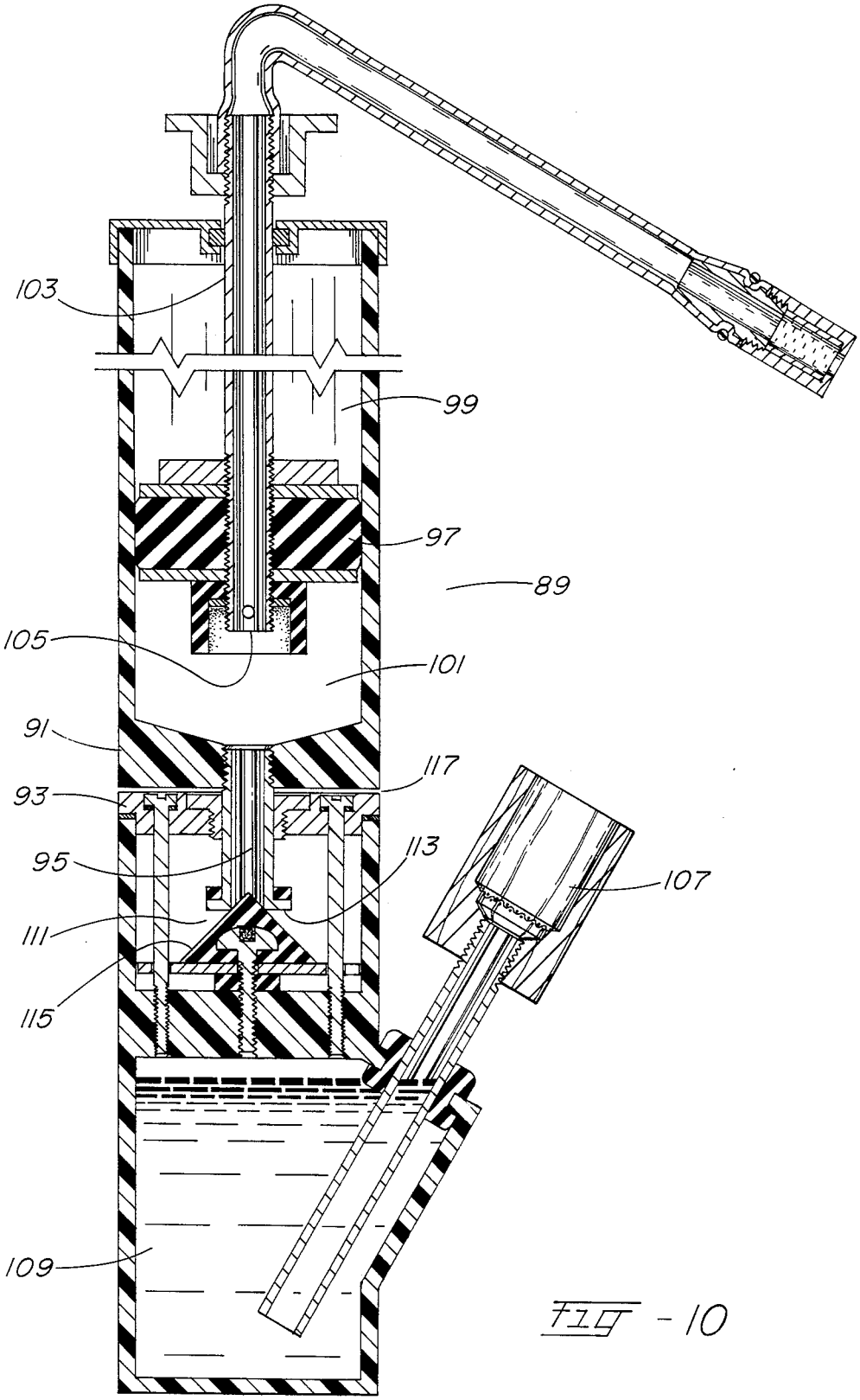
FIG. 10 is a cross-sectional view of a smoking device incorporating still another embodiment of this invention.

Referring now to FIG. 10 which shows a sectional view of another embodiment which is similar to the embodiment just described.

In this embodiment, the smoking device includes a cylindrical housing 89 having a closed top section 91 and a closed bottom section 93 connected for communication by a intermediate slidable passageway 95. A plunger 97 is carried within the closed top section 91 of the cylindrical housing 89 to provide an air chamber 99 and a smoke dilution chamber 101. A carbureting tube 103 passes through the air chamber 99 and fixed to the plunger 97. The inlet end 105 of the carbureting tube 103 is in communication with the smoke dilution chamber 101. The plunger is capable of up and down movement as described in the other embodiments. A combustion chamber 107 in communication with a water chamber 109, is also provided. An on-off valving system which is shown generally by 111, is also included. With this system, combustion gases may be drawn from the combustion chamber 107 through water in the water chamber 109 and into the smoke dilution chamber 101 through the intermediate passageway 95. The inlet end 113 of the passageway 95, as shown in FIG. 10, is blocked as it is in closed contact with a rubber stopper 115. The passageway may be opened by slidably pulling the closed top section 91 of the cylindrical housing 89 away from the bottom section 93, and thereby separating the stopper 115 from the inlet opening 113, as may be noted in FIG. 10. The intermediate passageway 95 is fixed to the top section and slidably held by the bottom section to permit the two sections (cylindrical housings) to be moved apart at about it's mid-point 117.

The remaining elements shown in FIG. 10 are essentially the same as the elements heretofore described in the previous embodiments.

The invention and its attendant advantages have been described in the foregoing description and specific references to the drawings. However, it should be understood that certain changes in form, construction, or arrangement may be made without departing from the spirit and scope as the above description is by way of example only. The restrictive scope of this invention is to be governed only by the claims recited below

I claim:

1. A smoking device comprising:

(a) a cylindrical housing having an outlet end and an inlet end, (b) a reciprocating pump-like plunger carried within said cylindrical housing and thereby to provide a smoke dilution chamber near said cylindrical housing's inlet end and an air chamber near said cylindrical housing's outlet end, (c) a combustion bowl having a burning chamber fixed to said cylindrical housing, (d) a passageway connecting said combustion bowl to said inlet end, (e) an on-off valve means operatively positioned between said burning chamber and said inlet end to permit smoke to pass from said burning chamber to said smoke dilution chamber when said valve is in an open position, (f) a cap means having at least one vent hole and a central opening for covering said outlet end of said cylindrical housing and (g) a slidable hollow carbureting tube extending through said central opening and into said smoke dilution chamber said carbureting tube having an inlet section and an outlet section, said inlet section having said pump-like plunger fixed thereto and said outlet section being extended beyond said cylindrical housing to permit pre-determined amounts of ambient air to be drawn into said smoke dilution chamber as said plunger is moved toward said outlet end of said cylindrical housing by regulating the degree to blockage imposed on said outlet section of said hollow carbureting tube.

2. The smoking device of claim 1 including a water chamber positioned intermediate said combustion chamber and said smoke dilution chamber to permit smoke to pass through water contained in said water chamber prior to entering said smoke dilution chamber.

3. The smoking device of claim 2 including a splash plate fixed within said cylindrical housing in an area between said water chamber and said smoke dilution chamber.

4. The smoking device of claim 3 wherein said water chamber is positioned prior to said on-off valve means.

5. The smoking device of claim 3 wherein said water chamber is positioned after said on-off valve means.

6. The smoking device of claim 4 including a filter-carrying mouthpiece fixed to said outlet section of said carbureting tube.

7. The smoking device of claim 6 wherein said on-off valve means is activated by rotation of said combustion bowl.

8. The smoking device of claim 10 wherein said on-off valve means is activated by slidably extending said cylindrical housing.

9. The smoking device of claim 6 including a stop means fixed to said inlet section of said hollow carbureting tube for cushioning contact of said pump-like plunger with said inlet end of said cylindrical housing.

10. The smoking device of claim 5 including a filter-carrying mouthpiece fixed to said outlet section of said carbureting tube.

11. The smoking device of claim 10 wherein said on-off valve means activated by rotation of said combustion bowl.

12. The smoking device of claim 10 wherein said on-off valve means is activated by slidably extending said cylindrical housing.

13. The smoking device of claim 10 including a stop means fixed to said inlet section of said hollow carbureting tube for cushioning contact of said pump-like plunger with said inlet end of said cylindrical housing.

* * * * *